US010395864B2

(12) United States Patent
Court

(10) Patent No.: US 10,395,864 B2
(45) Date of Patent: Aug. 27, 2019

(54) SWITCHING DEVICE COMPRISING A RESETTING DEVICE

(71) Applicant: Schneider Electric Industries SAS, Rueil Malmaison (FR)

(72) Inventor: Frederic Court, Saint Nicolas de Macherin (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 149 days.

(21) Appl. No.: 15/701,829

(22) Filed: Sep. 12, 2017

(65) Prior Publication Data

US 2018/0082810 A1 Mar. 22, 2018

(30) Foreign Application Priority Data

Sep. 16, 2016 (FR) ..... 16 58708

(51) Int. Cl.

| | |
|---|---|
| ***H01H 71/50*** | (2006.01) |
| ***H01H 21/30*** | (2006.01) |
| ***H01H 21/04*** | (2006.01) |
| ***H01H 21/36*** | (2006.01) |
| ***H01H 71/02*** | (2006.01) |
| ***H01H 71/52*** | (2006.01) |
| *H01H 71/32* | (2006.01) |
| *H01H 83/20* | (2006.01) |

(52) U.S. Cl.

CPC ..... *H01H 21/30* (2013.01); *H01H 21/04* (2013.01); *H01H 21/36* (2013.01); *H01H 71/0228* (2013.01); *H01H 71/52* (2013.01); *H01H 71/322* (2013.01); *H01H 71/521* (2013.01); *H01H 83/20* (2013.01)

(58) Field of Classification Search

CPC ..... H01H 71/50–71/64; H01H 73/24; H01H 73/38; H01H 73/50; H01H 83/00–83/226

See application file for complete search history.

(56) References Cited

U.S. PATENT DOCUMENTS

| | | | |
|---|---|---|---|
| 4,246,558 | A | 1/1981 | Zubaty et al. |
| 6,211,758 | B1 | 4/2001 | Castonguay et al. |
| 2002/0130743 | A1 | 9/2002 | Castonguay et al. |

FOREIGN PATENT DOCUMENTS

DE 10 2008 064 568 A1 6/2010

OTHER PUBLICATIONS

French Preliminary Search Report dated Jun. 20, 2017 in French Application 16 58708 filed on Sep. 16, 2016 (with English Translation of Categories of Cited Documents).

*Primary Examiner* — Ramon M Barrera

(74) *Attorney, Agent, or Firm* — Oblon, McClelland, Maier & Neustadt, L.L.P.

(57) ABSTRACT

A switching device includes a shell delimiting a plurality of spaces each able to accommodate a trip including a tripping device, a switching device, and a control mechanism including a device for grasping that can be moved between a first position and a second position by an operator in order to control movement of the switching device between an open position and a closed position. The switching device is in the closed position when the device for grasping is in the first position and in the open position when the device for grasping is in the second position. The control mechanism includes a single resetting device that resets each trip when the operator moves the device for grasping from the first position into the second position.

11 Claims, 6 Drawing Sheets

SWITCHING DEVICE COMPRISING A RESETTING DEVICE

Figure 1:
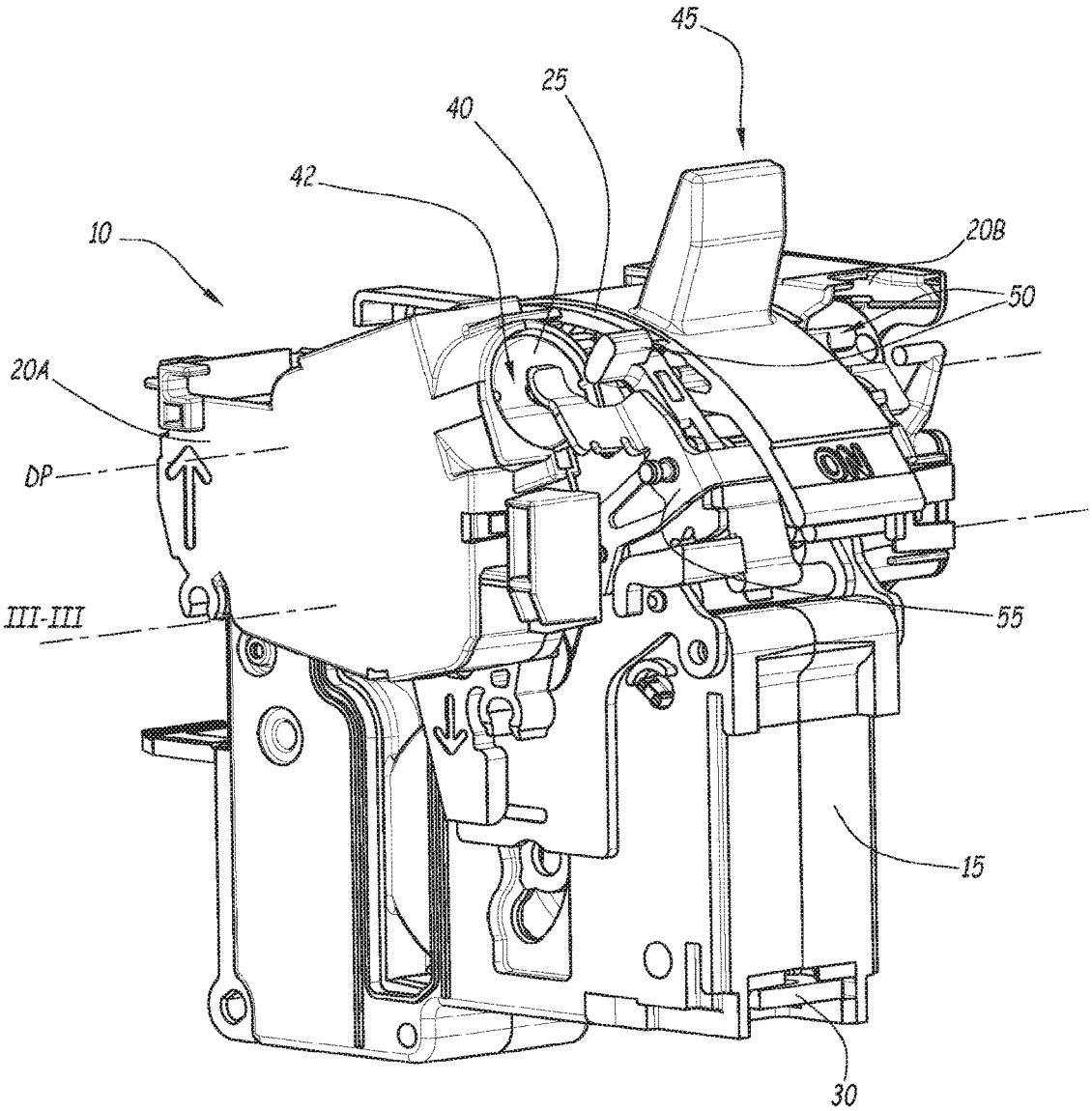

The present invention concerns a switching device.

Numerous switching devices include a switching device and a control device adapted to open or to close the switching device and therefore to prevent or to allow the passage of an electric current through the switching device. In particular, the control device enables the opening or the closing of the switching device in accordance with a precise specification, in particular in terms of the rapidity of opening.

Switching devices of this kind frequently include one or more trips. A trip is a module enabling opening to be commanded in the event of detection of an electrical fault, for example if a voltage is above or below predefined thresholds, or a short-circuit or an overcurrent.

In the event of detection of a fault of this kind, a mobile part of the trip moves from an initial position to a tripped position to actuate the control device and therefore to trip the opening of the switching device. In order to re-establish the flow of the electric current trips of this kind must therefore be reset when they have been tripped by the detection of a fault, i.e. the mobile part must be returned to its initial position to enable the switching device to be closed.

Trips are often supplied in the form of optional modules, which enables adaptation of the switching device to numerous different installations, each type of trip being designed to trip switching in response to specific faults. The same switching device therefore frequently includes a plurality of trips of different types.

However, when a plurality of trips are present it is necessary to ensure that all the trips are returned to their initial positions by actions that are as simple as possible for the operator. This is generally achieved by resetting devices carried by the trips. If only one of the resetting devices is faulty, the closing of the switching device is then rendered impossible. Moreover, resetting presupposes an accurate position of each trip.

Moreover, different types of trips often have different mechanical characteristics. In particular, the force necessary for resetting them is likely to vary from one type of trip to another. Accordingly, if the operator actuates a crank to close the switching device, different forces are exerted on the crank by the various trips. In time this results in wear and premature failure of the resetting device or the crank, for example buckling or twisting of the latter. This is particularly important for trips that must provide a large number of open/close cycles without failing.

An object of the invention is to propose a switching device that is more reliable than the prior art switching devices.

To this end there is proposed a switching device including:

a shell, a switching device including an input connection terminal and an output connection terminal and adapted to switch between a closed position allowing the passage of the current between the input connection terminal and the output connection terminal and an open position preventing the passage of the current between the input connection terminal and the output connection terminal, and a device for controlling the switching device, the control device including a grasping device movable between a first position and a second position by an operator to command the movement of the switching device between the open position and the closed position, the switching device being in the closed position when the grasping device is in the first position and being in the open position when the grasping device is in the second position, the shell further delimiting a plurality of spaces each able to accommodate a trip including a tripping device mobile between an armed position and a tripped position, the tripping device being configured to command the movement of the switching device from its closed position to its open position when the tripping device goes from its armed position to its tripped position.

The control device further includes a single resetting device configured to move the or each tripping device from its tripped position to its armed position when the operator moves the grasping device from the first position to the second position.

According to other advantageous but not obligatory features of the invention, the switching device includes one or more of the following features, separately or in all technically possible combinations:

the switching device includes trips, the resetting device being configured to move the tripping devices of the trips conjointly from their tripped positions to their respective armed positions when the operator moves the grasping device from the first position to the second position.

the grasping device includes a crank mobile in rotation about a first axis relative to the shell, the resetting device being mobile in rotation relative to the shell about a second axis parallel to the first axis, the crank coming to bear against the resetting device when the grasping device is moved by the operator from the first position to the second position.

the crank includes a handle, a bearing configured to allow rotation of the crank about the first axis and at least one arm connecting the handle to the bearing, the resetting device including at least one first branch and one second branch, the first branch having a first end and a second end, the first end bearing against the arm or one of the arms of the crank and the second end surrounding the second axis in a plane perpendicular to the second axis, the second branch having a third end in one piece with the second end and a fourth end bearing against the tripping device of a corresponding trip.

the switching device includes a first trip and a second trip, each trip being accommodated in a corresponding space of the shell, a resetting force being defined for each trip as being the minimum value of the force that the resetting device must apply to the tripping device of the trip to move the tripping device from its tripped position to its armed position, the resetting force of the first trip being different from the resetting force of the second trip, each resetting force corresponding to a bearing force exerted at a bearing point on a first branch by the or at least one arm of the crank, the resetting device being configured so that the bearing force corresponding to the first trip is equal to the bearing force corresponding to the second trip.

the resetting force of the first trip and the resetting force of the second trip have the same moment about the second axis.

each second branch includes a first portion and a second portion, the first portion connecting the second portion to the second end of the corresponding first branch, each second portion having a circular cylindrical face about a corresponding third axis, each third axis being parallel to the second axis, the cylindrical face coming to bear against the tripping device to move the tripping device to its armed position, a distance between the third axes being strictly greater than zero.

the crank includes two arms, the resetting device including two first branches and two second branches, each first branch extending in a direction perpendicular to the second axis, the resetting device further including a bar fastening together the first ends of the two first branches, the bar extending in a direction parallel to the second axis.

the or each arm of the crank has a bearing face, the first end of a corresponding first branch bearing against the bearing face, a distance being defined for each point of the bearing face between the point concerned and the first axis, an angle being defined for each point of the bearing face between the tangent to the bearing face at the point concerned and a line connecting the point to the first axis, the bearing face being concave and the angle increasing with the distance.

each first branch includes a roller configured to roll or to slide against the or at least one arm of the crank.

the switching device is a circuit breaker.

Figure 2:
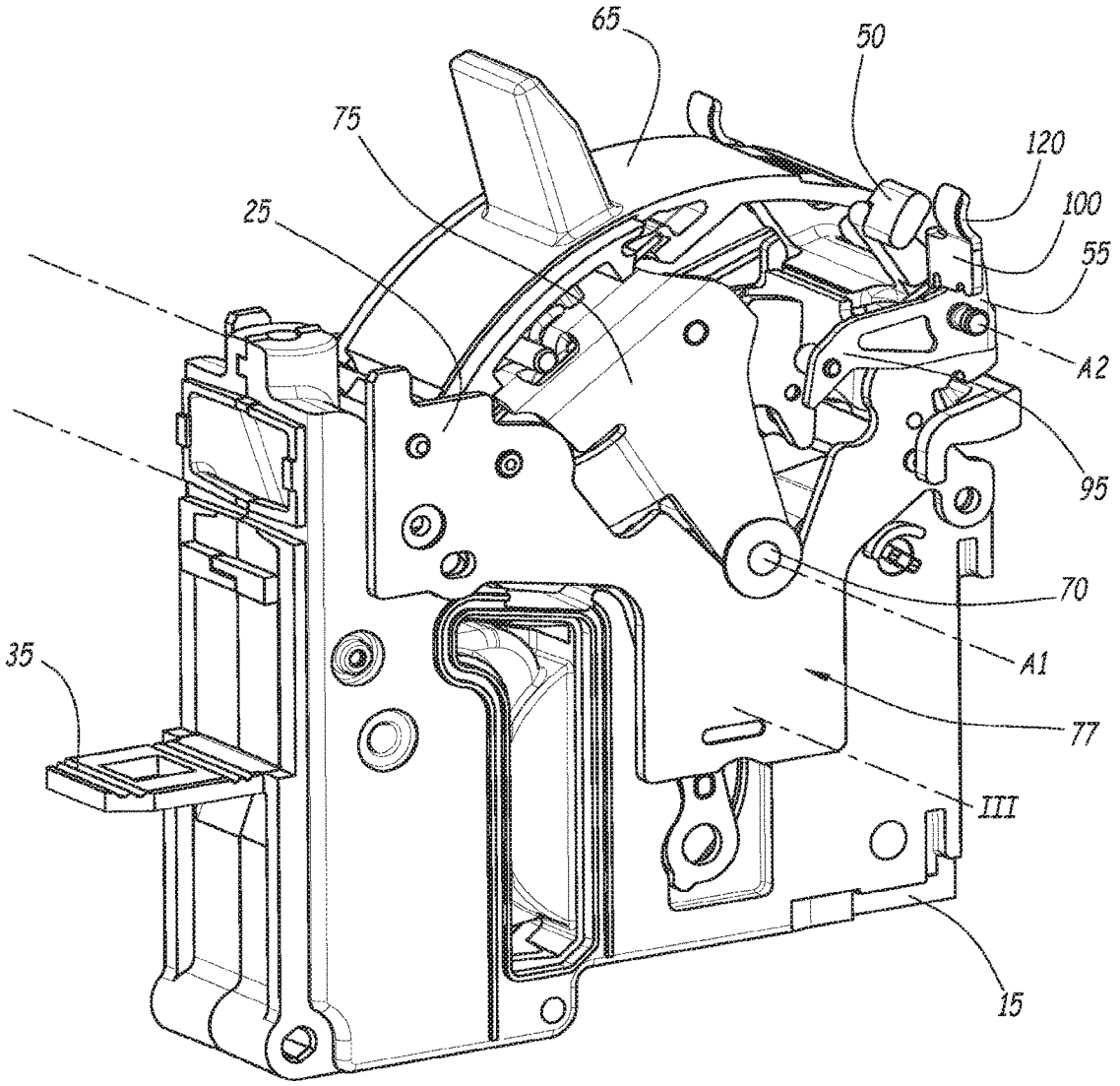
Figure 3:
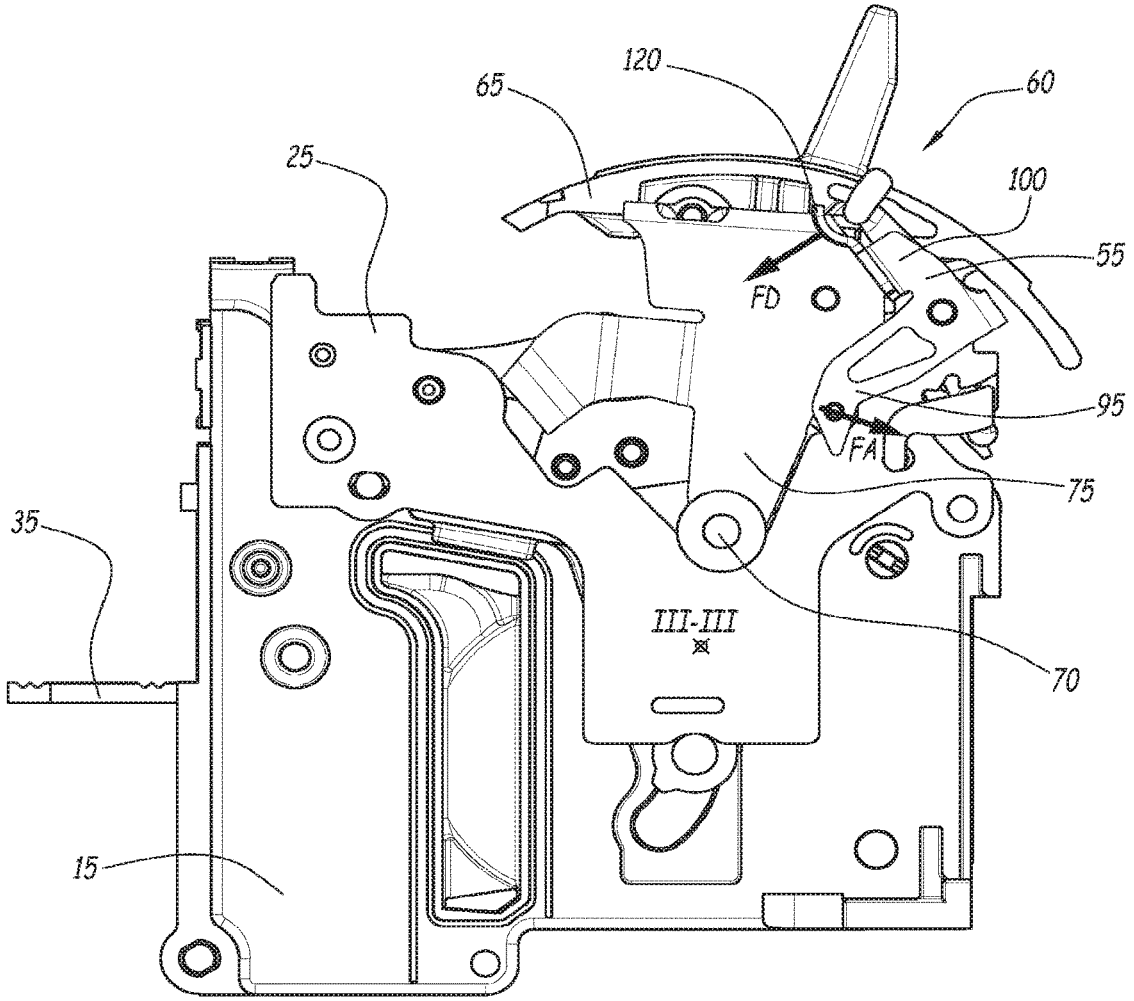
Figure 4:
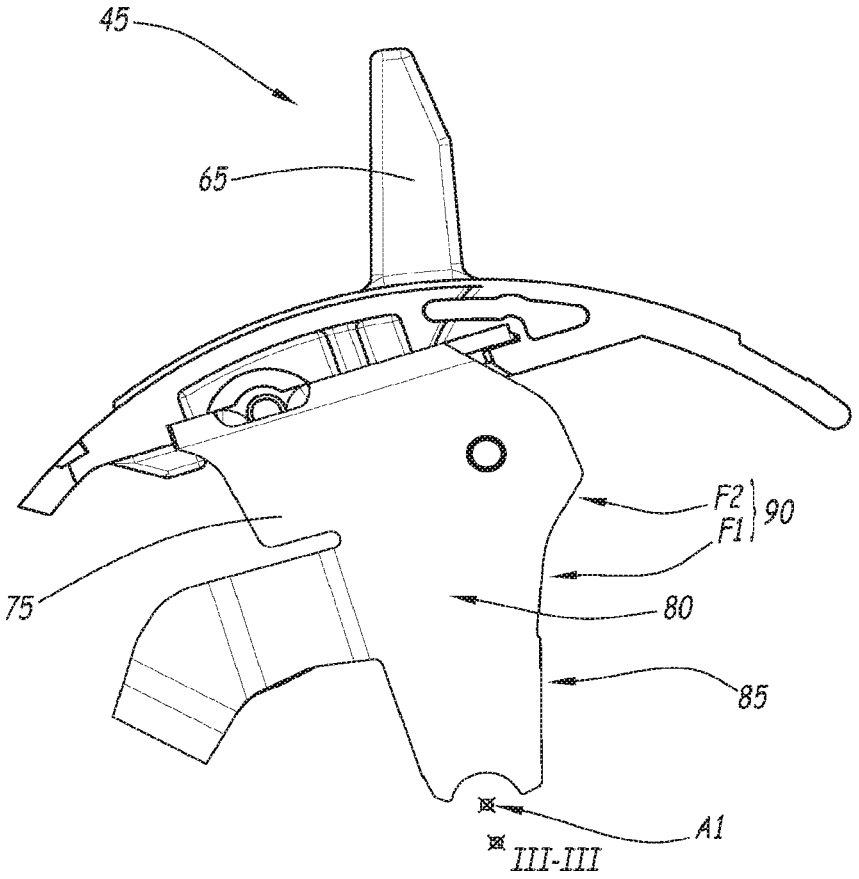
Figure 5:
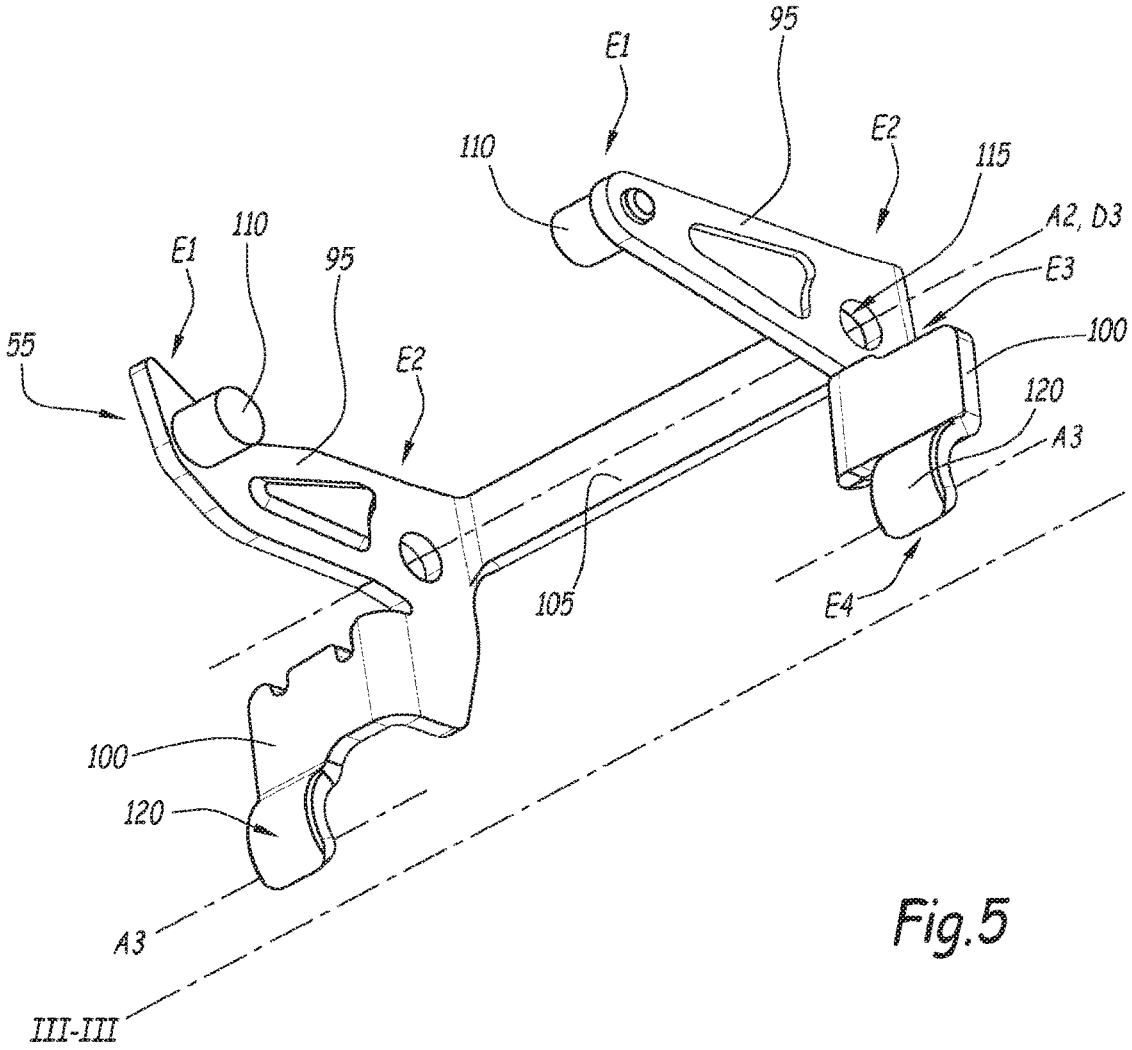
Figure 6:
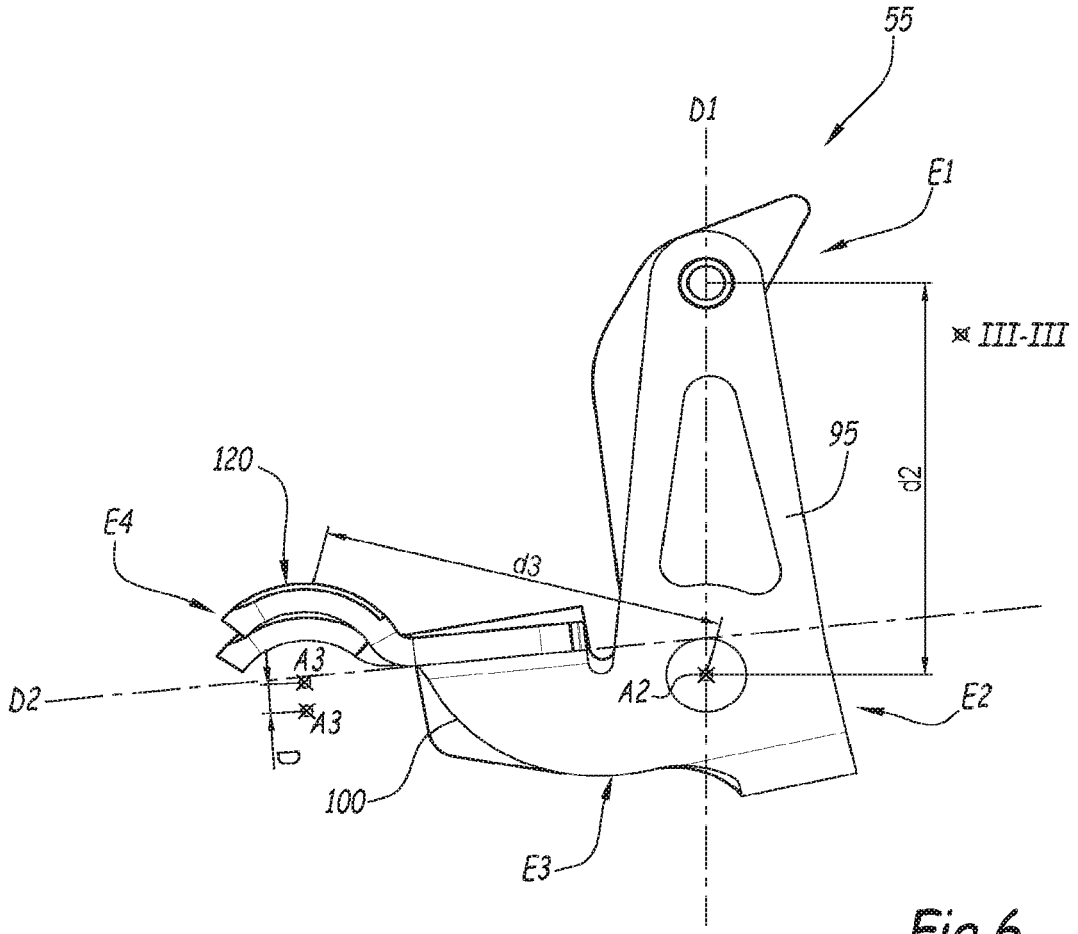

The features and advantages of the invention will become clear on reading the following description given by way of nonlimiting example only and with reference to the appended drawings, in which:

FIG. 1 is a perspective view of one example of a switching device according to the invention comprising a control device, a grasping device and a resetting device, the control device being in an open position, FIG. 2 is a perspective view of the switching device from FIG. 1, the control device being in a closed position, FIG. 3 is a view along the axis of the switching device from FIG. 1, FIG. 4 is a view along the axis of the grasping device from FIG. 1, FIG. 5 is a perspective view of the resetting device from FIG. 1, and FIG. 6 is a view along the axis of the resetting device from FIG. 1.

An axis III-III is represented in all the figures in order to explain better the respective orientations of the figures, and in particular FIGS. 3, 4 and 6.

A switching device 10 has been represented in FIG. 1.

The switching device 10 is a circuit breaker. For example, the switching device 10 is a three-phase circuit breaker.

In a variant, the switching device 10 is a switch such as a three-pole switch or a four-pole switch.

The switching device 10 includes a shell, at least one switching device 15, at least one trip 20 and a control device 25.

In a variant, the switching device 10 includes a plurality of switching devices 15. In particular, when the switching device 10 is a three-phase circuit breaker the switching device 10 includes three switching devices 15, one for each phase.

Instead of this or in addition to this, the switching device 10 includes a plurality of trips 20. According to the FIG. 1 example, the switching device 10 includes two trips 20.

Each tripping device 15 includes an input connection terminal 30 and an output connection terminal 35.

The switching device 15 is able to switch between a closed position and an open position.

When the switching device 15 is in the closed position the switching device 15 allows the passage of an electric current between the input connection terminal 30 and the output connection terminal 35.

When the switching device 15 is in the open position the switching device 15 prevents the passage of an electric current between the input connection terminal 30 and the output connection terminal 35.

Each switching device 15 is configured to be moved between the open position and the closed position by the control device 25.

The shell is configured to insulate the switching device 15, the trip or trips 20 and the control device 25 from the outside of the casing.

The shell delimits a chamber able to accommodate the switching device or devices 15, the trip or trips 20 and the control device 25. In particular, the envelope delimits a plurality of spaces each able to accommodate a trip 20. For example, the shell delimits two spaces.

According to one embodiment, the shell consists of the combination of a set of walls carried by separate parts. For example, the switching device 10 includes a cover, at least two partitions and at least one spacer separating two switching devices 15 from each other and further including a wall and the shell is formed by the combination at least of the wall, the two partitions and the cover.

In a variant, the shell includes a one-piece casing and a cover.

According to the FIG. 1 example, the switching device 10 includes a first trip and a second trip, each trip 20 being received in a corresponding space. The first trip is identified in FIG. 1 by a reference 20A and the second trip by a reference 20B.

Each trip 20 is configured to command the movement of the switching device 15 from its closed position to its open position. In particular, each trip 20 includes a tripping device 40. Each trip 20 is configured to move the corresponding tripping device 40 between an armed position and a tripped position.

Each trip 20 is removable from the shell. In particular, each trip 20 can be extracted from the shell independently of the control device 25.

In particular, each trip 20 is able to move the corresponding tripping device 40 from its armed position to its tripped position in response to the detection of an electrical fault. For example, each trip 20 is able to receive a signal from a detector on detection of the electrical fault.

The electrical fault is for example a short circuit current, an overload current or an insulation fault.

In a variant, a trip 20 is a no-voltage trip configured to move the tripping device 40 to its tripped position if a voltage of the electric current is below a single predetermined threshold.

According to another variant, at least one trip 20 is a current emission trip configured to move the tripping device 40 to its tripped position if a voltage of the electrical current is above a predetermined threshold.

The tripping device 40 is mobile relative to the control device 25 between its armed position and its tripped position.

The tripping device 40 is configured to command the movement of the switching device 15 from its closed position to its open position when the tripping device 40 goes from its armed position to its tripped position.

The tripping device 40 is for example in the form of a cylinder extending in a principal direction DP. The tripping device 40 then has an end face 42 perpendicular to the principal direction DP. The end face 42 delimits the tripping device 42 in the principal direction DP.

The tripping device 40 is for example mobile in translation in its principal direction DP between its armed position and its tripped position.

In a variant, the tripping device 40 is mobile in rotation between its armed position and its tripped position.

When the tripping device 40 is in its armed position the tripping device 40 is at least in part accommodated in a shell of the trip 20. When the tripping device 40 is in its armed position the trip 20 is able to command the switching of the switching device 15. For example, when the tripping device 40 is in its armed position a spring is compressed inside the trip 20. The spring is able, when it is released, to move the tripping device 40 from its armed position to its tripped position.

When the tripping device 40 is in its tripped position the tripping device 40 is at least in part extracted from the shell of the trip 20.

When the tripping device 40 goes from its armed position to its tripped position the tripping device 40 preferably moves from inside the shell of the trip 20 to outside the shell of the trip 20.

A resetting force Fr is defined for each trip 20. The resetting force Fr is the minimum value of the force that must be applied to the tripping device 40 of the trip 20 concerned to move the tripping device 40 from its tripped position to its armed position.

The resetting force Fr of the first trip 20A is different from the resetting force Fr of the second trip 20B.

A resetting travel is moreover defined for each trip 20. The resetting travel is the distance between a point of the tripping device 40 when the tripping device 40 is in its armed position and the same point when the tripping device 40 is in the tripped position.

No trip 20 is represented in FIG. 2 in order to enable the switching device 15 and the control device 25 to be seen better.

The control device 25 is configured to move the switching device 15 between its open position and its closed position.

The control device 25 includes a grasping device 45, at least one switch 50 and a single resetting device 55. The control system 25 preferably includes a switch 50 for each space receiving a trip 20.

The grasping device 45 is mobile relative to the switching device 15 between a first position and a second position.

The grasping device 45 is movable by an operator between the first position and the second position to command the movement of the switching device 15 between its open position and its closed position.

When the grasping device 45 is in the first position the switching device 15 is in its closed position.

When the grasping device 45 is in the second position the switching device 15 is in its open position.

In FIG. 2 the grasping device 45 is represented in its first position.

In FIG. 3 the grasping device 45 is represented in its second position.

The grasping device 45 is moreover able to come to bear against the resetting device 55 to move the resetting device 55 between a third position and a fourth position.

The grasping device 45 includes a crank 60 also termed a throw.

The crank 60 is mobile in rotation relative to the shell about a first axis A1.

The crank 60 is configured to come to bear against the resetting device 55 when the grasping device 45 is moved from its first position to its second position.

The crank 60 includes a handle 65, at least one bearing 70 and at least one arm 75. According to the FIG. 2 example, the crank 60 includes two arms 75.

The handle 65 is configured to enable an operator to move the grasping device 45 manually between its first position and its second position.

Each bearing 70 is configured to enable a respective rotation movement between the crank 60 and the other elements of the control device 25. Each bearing 70 is therefore able to guide an arm 75 in rotation about the first axis A1.

According to the FIG. 4 example, the crank 60 includes a bearing 70 for each arm 75.

For example, each bearing 70 is able to cooperate with a respective gear extending along the first axis A1 to enable rotation of the crank 60 about the first axis A1. In a variant, each bearing 70 is able to cooperate with a single first shaft common to the two bearings 70.

The arm or each arm 75 connects the handle 65 to the bearing(s) 70.

According to the FIG. 2 example, the two arms 75 are made in one piece and produced from a single metal part.

Each arm 75 is perpendicular to the first axis A1.

For example, each arm 75 is in the form of a plate perpendicular to the first axis A1. In this case, each arm 75 has two principal faces 80 and one lateral face 85.

The two principal faces 80 delimit the corresponding arm along the first axis A1. In this case, each principal face 80 is perpendicular to the first axis A1.

The lateral face 85 interconnects the two principal faces 80.

The lateral face 85 delimits the corresponding arm 75 in a plane perpendicular to the first axis A1.

A portion of the lateral face 85 forms a bearing face 90.

The bearing face 90 is configured to come to bear against the resetting device 55 when the grasping device 45 is moved to its second position.

According to the FIG. 4 example, the bearing face 90 is concave.

A first distance d1 and a first axis are defined for each point of the bearing face 90.

The first distance d1 is the distance between the point concerned and the point on the first axis A1 closest to the point concerned.

The first angle is the angle between the tangent to the bearing face 90 at the point concerned and a line connecting the point concerned to the first axis A1. Each tangent is in a plane perpendicular to the first axis A1.

The first angle increases with the first distance d1.

For example, for each set of two points of the bearing face 90 a line connecting the two points concerned is formed of points each being part of the bearing face 90 or not being part of the arm 75.

For example, the bearing face 90 includes two facets F1 and F2, each facet F1, F2 being plane and the two facets F1, F2 defining in a plane perpendicular to the first axis A1 a second angle that faces toward the exterior of the arm 75. The second angle has a value between 90 degrees (°) and 180 degrees, inclusive, for example.

In other words, the second angle is a function of the first distance d1 defined by two affine functions, each affine function being defined over a respective range of first distances d1, the two ranges being successive, and the director coefficient of the affine function corresponding to the range at the greatest distance from the first axis A1 is strictly greater than the director coefficient of the other affine function.

In a variant, the second angle is a function of the first distance d1 the second derivative of which is strictly positive.

Each switch 50 is configured to command the switching of the switching device 15 from its closed position to its open position when the corresponding tripping device 40 goes from its armed position to its tripped position.

Each switch 50 is for example a button mobile relative to the shell and adapted to be actuated by the corresponding tripping device 40 when the latter reaches its tripped position.

The resetting device 55 is configured to move the or each tripping device 40 from its tripped position to its armed position when the operator moves the grasping device 45 from its first position to its second position.

There is only one resetting device 55. In particular, if the switching device 10 includes a plurality of trips 20 the resetting device 55 is configured to move the tripping devices 40 of the trips 20 conjointly from their tripped positions to their respective armed positions.

The resetting device 55 is preferably configured to move all the tripping devices 40 simultaneously to their respective armed positions when the operator moves the grasping device 45 from its first position to its second position.

The resetting device 55 is part of the control device 25. In particular the resetting device 55 cannot be extracted from the shell independently of the other elements of the control device 25.

For example, the resetting device 55 is not removable from the casing.

The resetting device 55 is mobile in rotation relative to the casing about a second axis A2. The second axis A2 is parallel to the first axis A1.

In particular, the resetting device 55 is mobile in rotation between its third position represented in FIG. 2 and its fourth position represented in FIG. 3.

When the resetting device 55 is in the third position the resetting device 55 is not in contact with the tripping device 40 of any trip 20. Moreover, when the resetting device 55 is in the third position and the grasping device 45 is in its first position the resetting device 55 and the grasping device 45 are not in contact with each other.

When the resetting device 55 is in the fourth position the resetting device 55 bears against all the tripping devices 40, each of which is in the armed position.

The resetting device 55 includes at least one first branch 95 and at least one second branch 100.

According to the FIG. 5 example, the resetting device 55 includes two first branches 95, two second branches 100 and a bar 105.

The resetting device 55 is configured to transmit a movement of the grasping device 45 from its first position to its second position to the or at least one tripping device 40. For example, the resetting device 55 is configured to exert a displacement force FD on the or at least one of the tripping devices 40 in response to a bearing force FA exerted by the grasping device 45 as it moves. Each displacement force FD tends to move the corresponding tripping device 40 toward its armed position.

The resetting device 55 is in one piece.

Each first branch 95 has a first end E1 and a second end E2.

Each first branch 95 extends in a first direction D1. The first direction D1 is perpendicular to the second axis A2.

Each first end E1 is adapted to come to bear against the arm 75 or one of the arms 75 of the grasping device 45 when an operator moves the grasping device 45 toward its second position.

In particular, when the resetting device 55 includes two first branches 95 and the crank 60 includes two arms 75 each first end E1 is adapted to come to bear against the bearing face 90 of a corresponding arm 75.

Each first end E1 has a bearing point. The bearing point is the point of the first end E1 at which the bearing force FA is exerted by the arm 75.

According to the FIG. 5 example each first end E1 includes a roller 110. Each roller 110 is configured to roll or slide against the arm 75 or one of the arms 75 of the crank 60.

In particular, each roller 110 is adapted to roll or to slide against the bearing face 90 of a corresponding arm 75.

The bearing point is therefore a point on the roller 110.

According to the FIG. 5 example, the rollers 110 are disposed between the two first branches 95.

In a variant, the resetting device 55 does not include rollers 110.

The second end E2 surrounds the second axis A2 in a plane perpendicular to the second axis A2. For example, the second end E2 delimits a hole 115 receiving a second shaft. Each hole 115 is for example a circular cylinder about the second axis A2.

Each second branch 100 is configured to come to bear against the tripping device 40 of a corresponding trip 20.

Each second branch 100 extends in a second direction D2. The second direction D2 is perpendicular to the second axis A2.

The second direction D2 is different from the first direction D1. For example, the second direction D2 forms an angle with the first direction D1 equal to 98°, to the nearest 15°.

Each second direction D2 preferably defines with the first direction D1 of the first branch 95, with which its third end E3 is made in one piece, a plane perpendicular to the second axis A2.

Each second branch 100 includes a first portion P1 and a second portion P2.

The first portion P1 has a third end E3. The first portion P1 is delimited in the second direction D2 by the third end E3 and by the second portion P2.

The third end E3 is in one piece with the second end E2. The first portion P1 therefore connects the second portion P2 and the second end E2 of the first branch 95.

The second portion P2 has a fourth end E4 and a cylindrical face 120.

The second portion P2 is delimited in the second direction D2 by the fourth end E4 and by the first portion P1.

The fourth end E4 is adapted to come to bear against the tripping member 40 of a corresponding trip 20.

The cylindrical face 120 of each second branch 100 is a cylinder with a circular base about a third axis A3.

Each cylindrical face 120 is adapted to come to bear against the end face 42 of a corresponding tripping device 40 and to exert the displacement force FD on the end face 42.

A radius R is defined for each cylindrical face 120. The radius R is the radius of the cylindrical face 120 about the third axis A3.

The two radii R of the two cylindrical faces 120 of the same resetting device 55 are equal. According to a variant, the two radii R are different from each other.

Each third axis A3 is parallel to the second axis A2.

A second distance d2 measured in the first direction D1 is defined between the bearing point of a first branch 95 and the second axis A2. A third distance d3 is defined between the application point on the cylindrical face 120 of the corresponding second branch 100 and the second axis A2.

The resetting device 55 is configured so that the bearing force FA corresponding to the resetting force Fr of the first trip 20A is equal to the bearing force FA corresponding to the resetting force Fr of the second trip 20B.

By "bearing force FA corresponding to the resetting force Fr" of a trip 20 is meant a value of the bearing force FA for which the resetting force Fr exerted on the tripping device 40 by the resetting device 55 is equal to the resetting force of the trip 20 concerned.

For example, the second distances d2 of the two first branches 95 are equal to each other. In this case, the third distance d3 of the two second branches 100 are such that the product of the third distance d3 of a second branch 100 and the bearing force FA corresponding to the resetting force Fr of the corresponding trip 20 is identical for both the second branches 100.

The resetting device 55 is then configured so that the resetting force Fr of the first trip 20A and the resetting force Fr of the second trip 20B have the same moment about the second axis A2.

For example, the third axes A3 of the two second branches 100 of the same resetting device 55 do not coincide. In other words, a distance D between the two third axes A3 is strictly greater than 0. For example, the distance D is greater than or equal to 1 millimeter (mm).

The distance D can be seen in FIG. 6. The two third distances d3 are therefore different from each other.

In a variant, the two third distances are equal to each other but the two second distances d2 are different from each other.

The bar 105, also termed a flange, connects the two first ends E1 of the two first branches 95 of the same resetting device 55. The bar 105 is adapted to fasten together the two first ends E1. The bar 105 therefore fastens together two pairs of branches, each pair comprising a first branch 95 and a second branch 100 in one piece with each other.

The bar 105 extends in a third direction D3. The third direction D3 is parallel to the second axis A2.

The operation of the switching device 10 will now be described.

In an initial step the switching device 15 is in its closed position and an electric current flows through the switching device 15 between the input connection terminal 30 and the output connection terminal 35.

During the initial step the grasping device 45 is in its first position, visible in FIG. 2. Moreover, the tripping device 40 of each trip 20 is its armed position and the resetting device 55 is in its third position.

During a detection step an electrical fault is detected by at least one trip 20. The trip or trips 20 that have detected the electrical fault then trip the switching of the switching device 15, i.e. the tripping device 40 of each trip 20 that has detected an electrical fault goes from its armed position to its tripped position. In doing so, the tripping device 40 actuates the corresponding switch 50 which leads to the control device 25 moving the switching device 15 from its closed position to its open position. The electric current is then cut off by the switching device 15.

In the detection step the grasping device 45 moves from its first position to an intermediate position between its first and second positions. In a variant, at the end of the detection step the grasping device 45 is in its first position.

Then, in a resetting step, an operator actuates the grasping device 45 to enable the current to flow again. For example, the operator has resolved the electrical fault and now wishes to re-establish the supply of electrical power to an installation.

To this end the operator manually causes the grasping device 45 to pivot about the first axis A1 to its second position.

During the movement of the grasping device 45 toward its second position the grasping device reaches a fifth position. The fifth position is an intermediate position between the first position and the second position.

When the grasping device 45 is in the fifth position and the resetting device 55 is in the third position the grasping device 45 bears against the resetting device 55. To be more precise, each of the rollers 110 is then in contact with the second facet F2 of the bearing face 90 of a corresponding arm 75.

The movement of the grasping device 45 from its fifth position to its second position then causes the resetting device 55 to pivot about the second axis A2 from the third position to the fourth position.

The rollers 110 then roll successively against the second facet F2 and then against the first facet F1.

A bearing force FA is then exerted on each first end E1 by the arm 75 against which that first end E1 bears. The bearing force FA tends to cause the resetting device 55 to pivot from its third position to its fourth position.

The movement of the resetting device 55 toward its fourth position brings the fourth end E4 of at least one second branch 100 to bear against the corresponding tripping device 40. To be more precise, the cylindrical face 120 of the second branch 100 comes to bear against the end face 42 of the tripping device 40.

Pivoting to its fourth position, the resetting device 55 therefore exerts a displacement force FD on the or each tripping device 40 against which it bears.

The or each tripping device 40 bearing against the resetting device 55 is then moved to its armed position.

If a plurality of tripping devices 40 were in their tripped position, those tripping devices 40 are returned simultaneously to their respective armed position by the resetting device 55.

The use of a single resetting device 55 integrated into the control device 25 makes it possible to simplify the production of the switching device 10. Moreover, the switching device 10 is more reliable than prior art switching devices that include a resetting device incorporated into each trip and are therefore liable to be rendered inoperative following the failure of a single resetting device.

The resetting device 55 is easy to manufacture and operates reliably because of its great simplicity. In particular, the resetting device 55 reliably resets the various trips 20. In fact, as resetting involves few components the operation of the resetting device 55 is relatively insensitive to mechanical play.

Moreover, if a plurality of trips 20 of different types are used the resetting device 55 necessitates the same bearing force FA to enable the resetting of each trip 20. The forces exerted by the resetting device 55 on the various arms 75 of the crank 60 are therefore identical, which reduces the risk of the crank 60 twisting. Once again, the switching device 10 is more reliable.

Moreover, the resetting device 55 does not presuppose that the tripping devices 40 have identical travels.

The geometry of the bearing face 90 makes it possible to minimize the forces exerted on the crank 60 by the resetting device 55 whilst ensuring that the bearing force FA always applies a sufficient rotation torque to the resetting device 55. In particular, when the rollers 110 roll against the second facet F2 there is a large angle between the direction in which the bearing force FA is exerted and a line connecting the bearing point to the second axis A2 and the torque is therefore high.

When the rollers 110 roll against the first facet F1, i.e. at the end of the movement of the crank 60 toward the second position, the rotation torque acting on the crank 60 is low. Moreover, the orientation of the first facet F1 allows a large amplitude of movement of the grasping device 45.

The invention has been described hereinabove in the situation where the resetting device 55 includes two pairs of branches, each pair of branches including a first branch 95 and a second branch 100. The person skilled in the art will easily understand that the number of pairs can vary as a function of a number of trips 20 used.

According to a variant, the number of first branches 95 is different from the number of second branches 100. For example, the resetting device 55 includes a single first branch 95 coming to bear against the crank 60 and a plurality of second branches 100, one second branch 100 for each trip 20.

According to another variant, the resetting device 55 includes a single second branch 100.

The invention claimed is:

1. A switching device comprising:

a shell, a switching device including an input connection terminal and an output connection terminal and adapted to switch between a closed position allowing the passage of the current between the input connection terminal and the output connection terminal and an open position preventing the passage of the current between the input connection terminal and the output connection terminal, and a device for controlling the switching device, the control device including a grasping device movable between a first position and a second position by an operator to command the movement of the switching device between the open position and the closed position, the switching device being in the closed position when the grasping device is in the first position and being in the open position when the grasping device is in the second position, the shell further delimiting a plurality of spaces each able to accommodate a trip including a tripping device mobile between an armed position and a tripped position, the tripping device being configured to command the movement of the switching device from its closed position to its open position when the tripping device goes from its armed position to its tripped position, wherein the control device further includes a single resetting device configured to move each tripping device from its tripped position to its armed position when the operator moves the grasping device from the first position to the second position.

2. The switching device according to claim 1, including trips, the resetting device being configured to move the tripping devices of the trips conjointly from the tripped positions to the respective armed positions when the operator moves the grasping device from the first position to the second position.

3. The switching device according to claim 1, wherein the grasping device includes a crank mobile in rotation about a first axis relative to the shell, the resetting device being mobile in rotation relative to the shell about a second axis parallel to the first axis, the crank coming to bear against the resetting device when the grasping device is moved by the operator from the first position to the second position.

4. The switching device according to claim 3, wherein the crank includes a handle, a bearing configured to allow rotation of the crank about the first axis and at least one arm connecting the handle to the bearing, the resetting device including at least one first branch and one second branch, the first branch having a first end and a second end, the first end bearing against the arm or one of the arms of the crank and the second end surrounding the second axis in a plane perpendicular to the second axis, the second branch having a third end in one piece with the second end and a fourth end bearing against the tripping device of a corresponding trip.

5. The switching device according to claim 4, including a first trip and a second trip, each trip being accommodated in a corresponding space of the shell, a resetting force being defined for each trip as being the minimum value of the force that the resetting device must apply to the tripping device of the trip to move the tripping device from the tripped position to the armed position, the resetting force of the first trip being different from the resetting force of the second trip, each resetting force corresponding to a bearing force exerted at a bearing point on a first branch by at least one arm of the crank, the resetting device being configured so that the bearing force corresponding to the first trip is equal to the bearing force corresponding to the second trip.

6. The switching device according to claim 5, wherein the resetting force of the first trip and the resetting force of the second trip have the same moment about the second axis.

7. The switching device according to claim 6, wherein each second branch comprises a first portion and a second portion, the first portion connecting the second portion to the second end of the corresponding first branch, each second portion having a circular cylindrical face about a corresponding third axis, each third axis being parallel to the second axis, the cylindrical face coming to bear against the tripping device to move the tripping device to the armed position, a distance between the third axes being strictly greater than zero.

8. The switching device according to claim 4, wherein the crank includes two arms, the resetting device including two first branches and two second branches each first branch extending in a direction perpendicular to the second axis, the resetting device further including a bar fastening together the first ends of the two first branches, the bar extending in a direction parallel to the second axis.

9. The switching device according to claim 4, wherein each arm of the crank has a bearing face, the first end of a corresponding first branch bearing against the bearing face, a distance being defined for each point of the bearing face between the point concerned and the first axis, an angle being defined for each point of the bearing face between the tangent to the bearing face at the point concerned and a line connecting the point to the first axis, the bearing face being concave and the angle increasing with the distance.

10. The switching device according to claim 4, wherein each first branch includes a roller configured to roll or to slide against at least one arm of the crank.

11. The switching device according to claim 1, wherein the switching device is a circuit breaker.

* * * * *